US011180272B2

(12) United States Patent
Gabrielli

(10) Patent No.: US 11,180,272 B2
(45) Date of Patent: Nov. 23, 2021

(54) METHOD AND APPARATUS FOR COMPRESSING AN ELONGATE STACK OF FOLDED TISSUES

(71) Applicant: Essity Hygiene and Health Aktiebolag, Gothenburg (SE)

(72) Inventor: Massimo Gabrielli, Coreglia Antelminelli (IT)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 16/970,020

(22) PCT Filed: Feb. 14, 2018

(86) PCT No.: PCT/EP2018/053712

§ 371 (c)(1),
(2) Date: Aug. 14, 2020

(87) PCT Pub. No.: WO2019/158197

PCT Pub. Date: Aug. 22, 2019

(65) Prior Publication Data

US 2021/0009299 A1 Jan. 14, 2021

(51) Int. Cl.
*B65B 63/02* (2006.01)
*B65B 11/50* (2006.01)
(Continued)

(52) U.S. Cl.
CPC ..... *B65B 63/02* (2013.01); *B65B 11/50* (2013.01); *D21H 27/002* (2013.01); *D21H 27/02* (2013.01)

(58) Field of Classification Search
CPC ..... B65B 63/02; B65B 63/022; B65B 63/026; B65B 25/14; B65B 25/145; B65B 13/20;
(Continued)

(56) References Cited

U.S. PATENT DOCUMENTS 2,960,023 A * 11/1960 Greiner ..... B65B 63/026 100/152
3,191,356 A * 6/1965 Zelnick ..... B65B 51/303 53/555
(Continued)

FOREIGN PATENT DOCUMENTS

CN 103648938 A 3/2014
CN 104540740 A 4/2015
(Continued)

OTHER PUBLICATIONS

Clarkson, Paul Magnus (NLO European Patent and Trademark Attorneys), Response to Written Opinion and Search Report, dated Dec. 13, 2019 (9 pages).
(Continued)

*Primary Examiner* — Dariush Seif
(74) *Attorney, Agent, or Firm* — Buchanan Ingersoll & Rooney P.C.

(57) ABSTRACT

A method and apparatus are disclosed for compressing an elongate stack of folded absorbent tissues to form a tissue log. A stack of folded absorbent tissues is transported along a compression path from an input end to an output end, the compression path being defined between first and second opposed transport surfaces provided on first and second compression members. The first compression member is moved towards the second compression member from a first spacing to a second spacing to compress the stack and form the log. The compression path has a length greater than the stack length and during compression, the stack moves along the compression path with respect to the compression members. During this process, the stack will be compressed from a first height to a second height corresponding to the second spacing.

21 Claims, 7 Drawing Sheets

(51) Int. Cl.
*D21H 27/00* (2006.01)
*D21H 27/02* (2006.01)

(58) Field of Classification Search
CPC . B65B 35/44; B65B 35/50; B65H 2301/4223; B65G 15/14; B30B 5/06; B30B 5/04; D21H 27/02; D21H 27/002
USPC ..... 53/439, 529, 438, 436; 100/151, 152
See application file for complete search history.

(56) References Cited

U.S. PATENT DOCUMENTS 3,490,194 A * 1/1970 Monaghan ..... B65B 9/026 53/450
3,837,138 A * 9/1974 Terry ..... B65B 63/026 53/439
3,848,398 A * 11/1974 Suhr ..... B65B 9/026 53/530
3,982,375 A * 9/1976 Focke ..... B65B 19/228 53/466
RE29,372 E * 8/1977 O'Brien ..... B30B 15/30 100/49
4,110,954 A * 9/1978 Olsson ..... B65B 9/02 53/433
4,230,218 A * 10/1980 Kunzmann ..... B65H 31/3027 198/461.3
4,377,061 A * 3/1983 Olson ..... B65B 9/02 53/433
4,410,474 A * 10/1983 Ahrweiler ..... B30B 5/06 264/109
4,573,404 A * 3/1986 Held ..... B30B 5/04 100/151
4,738,078 A * 4/1988 Benz ..... B65B 11/10 53/439
4,751,807 A * 6/1988 Couturier ..... B65B 63/04 493/444
5,022,216 A * 6/1991 Muckenfuhs ..... B65B 63/02 53/438
5,189,864 A * 3/1993 Cinotti ..... B65B 25/14 53/228
5,396,752 A * 3/1995 Mastropasqua ..... B65B 27/08 53/528
5,459,979 A * 10/1995 Tommasi ..... B65B 25/145 100/26
5,704,191 A * 1/1998 Wallace ..... B65B 63/04 53/116
5,853,547 A 12/1998 Ahrens et al.
5,979,145 A * 11/1999 Louis ..... B65B 63/022 53/439
6,112,501 A * 9/2000 Pollock ..... B65B 63/02 100/218
6,170,635 B1 * 1/2001 Rommelli ..... B65G 47/5127 198/429
6,342,115 B1 * 1/2002 Pourmand ..... B30B 5/06 100/308
6,571,694 B1 * 6/2003 Gustafsson ..... B65B 51/20 100/151
6,592,694 B1 * 7/2003 Willman ..... B32B 37/10 156/64
6,669,813 B1 * 12/2003 Melzer ..... B30B 5/06 156/358
6,708,465 B1 * 3/2004 Gustafsson ..... B65B 51/20 53/370.8
6,865,861 B2 * 3/2005 White ..... B65B 25/14 53/228
7,104,031 B2 * 9/2006 Baggot ..... B65B 63/02 53/439
7,302,781 B2 * 12/2007 Michler ..... B65B 9/026 53/389.3
7,374,045 B2 * 5/2008 DiLiberto ..... B65B 63/02 206/524.8
7,398,630 B2 * 7/2008 Kovacs ..... B65B 9/067 198/461.1
7,481,033 B2 * 1/2009 Ouellette ..... B65B 9/02 53/209
7,503,153 B2 * 3/2009 De Matteis ..... B65B 11/10 53/223
7,527,709 B2 5/2009 Fernandes et al.
7,550,061 B2 6/2009 Walkenhaus et al.
7,610,737 B2 * 11/2009 Kovacs ..... B65B 9/067 53/374.6
7,721,511 B2 * 5/2010 De Matteis ..... B65B 11/10 53/399
7,744,726 B2 6/2010 Scherb et al.
7,823,368 B2 * 11/2010 Hansen ..... B65B 9/026 53/510
7,870,960 B2 * 1/2011 DiLiberto ..... B65B 5/045 206/524.8
8,568,080 B2 * 10/2013 Paganini ..... B65G 57/32 414/797.7
9,334,071 B2 * 5/2016 Tommasi ..... B65B 63/02
10,450,095 B2 * 10/2019 Brandhorst ..... B65B 59/005
10,602,886 B2 * 3/2020 Wallenius ..... B65B 63/02
2002/0073649 A1 * 6/2002 Gamberini ..... B65B 11/10 53/228
2002/0192548 A1 * 12/2002 Schaefer ..... B30B 5/06 429/209
2003/0183550 A1 * 10/2003 DiLiberto, Jr. ..... B65D 75/38 206/524.8
2005/0044815 A1 * 3/2005 Forte ..... B65B 9/026 53/438
2006/0059863 A1 * 3/2006 Michler ..... B65B 25/14 53/399
2006/0168884 A1 * 8/2006 Weder ..... B65D 85/07 47/72
2007/0221532 A1 * 9/2007 DiLiberto ..... B65B 63/02 206/524.8
2007/0271872 A1 * 11/2007 De Matteis ..... B65B 11/10 53/228
2007/0272788 A1 * 11/2007 De Matteis ..... B65B 11/10 242/521
2007/0277479 A1 * 12/2007 Hansen ..... B65B 9/026 53/436
2009/0320697 A1 * 12/2009 Rago ..... B30B 5/06 100/35
2011/0277427 A1 * 11/2011 Martin ..... B65B 35/46 53/540
2011/0289892 A1 * 12/2011 Zaninelli ..... B65B 9/026 53/529
2013/0219837 A1 * 8/2013 Tommasi ..... B65B 25/145 53/529
2013/0269893 A1 * 10/2013 Nelvig ..... B65B 63/02 162/111
2014/0134376 A1 5/2014 Larsson
2014/0137515 A1 * 5/2014 Brandhorst ..... B65B 63/026 53/439
2015/0140309 A1 * 5/2015 Pricone ..... B29C 59/022 428/220
2015/0203231 A1 * 7/2015 Brandhorst ..... B65B 57/005 100/35
2016/0031202 A1 * 2/2016 Stevens ..... B30B 5/02 156/64
2016/0151940 A1 * 6/2016 Kang ..... B30B 5/06 425/329
2017/0087787 A1 * 3/2017 Yun ..... B29C 43/24
2018/0160867 A1 * 6/2018 Wallenius ..... A47K 10/20
2019/0009429 A1 * 1/2019 Stefani ..... B28B 3/024
2019/0016011 A1 * 1/2019 Stefani ..... B28B 5/021
2019/0061197 A1 * 2/2019 Stefani ..... B30B 5/06

FOREIGN PATENT DOCUMENTS

EP 1156925 A1 11/2001
EP 1860031 A1 11/2007
EP 1860033 A1 11/2007
RU 2388667 C2 5/2010
WO 0073188 A1 12/2000
WO 2005080208 A1 9/2005

(56) References Cited

FOREIGN PATENT DOCUMENTS

| | | | |
|---|---|---|---|
| WO | 2006041435 | A1 | 4/2006 |
| WO | 2012087211 | A1 | 6/2012 |
| WO | 2016209124 | A1 | 12/2016 |

OTHER PUBLICATIONS

International Searching Authority, Written Opinion issued in International Patent Application No. PCT/EP2018/053712, dated Oct. 19, 2018 (5 pages).
International Searching Authority, Search Report issued in International Patent Application No. PCT/EP2018/053712, dated Oct. 19, 2018 (5 pages).
International Searching Authority, International Preliminary Report on Patentability issued in International Patent Application No. PCT/EP2018/053712, dated Jan. 30, 2020 (12 pages).
Office Action (Notification of the First Office Action) dated Dec. 2, 2020 by the China National Intellectual Property Administration (CNIPA) of the People's Republic of China in corresponding Chinese Patent Application No. 201880089056.5, and an English Translation of the Office Action. (10 pages).
Office Action (Decision on Grant) dated Nov. 3, 2020, by the Federal Service for Intellectual Property in Russian Patent Application No. 2020129819/11(053733) and an English Translation of the Office Action. (17 pages).

* cited by examiner

METHOD AND APPARATUS FOR COMPRESSING AN ELONGATE STACK OF FOLDED TISSUES

CROSS-REFERENCE TO RELATED APPLICATION

This application is a national phase entry of, and claims priority to, International Application No. PCT/EP2018/053712, filed Feb. 14, 2018. The above-mentioned patent application is incorporated herein by reference in its entirety.

TECHNICAL FIELD

The present application relates to a method of handling tissues, in particular, the type of tissues that are provided as a stack of folded individual tissues for use in dispensers. The application further relates to a method and apparatus for compressing elongate stacks of such tissues to form compressed tissue logs.

BACKGROUND

Stacks of absorbent tissue paper material are used for providing web material to users for wiping, drying and or cleaning purposes. Conventionally, the stacks of tissue paper material are designed for introduction into a dispenser, which facilitates feeding of the tissue paper material to the end user. Also, the stacks provide a convenient form for transportation of the folded tissue paper material. To this end, the stacks are often provided with a packaging, to maintain and protect the stack during transport and storage thereof.

Accordingly, packages are provided comprising a stack of tissue paper material, and a corresponding packaging. During transportation of packages containing tissue paper material, there is a desire to reduce the bulk of the transported material. Typically, the volume of a package including a stack of tissue paper material includes substantial amounts of air between panels and inside the panels of the tissue paper material. Hence, substantial cost savings could be made if the bulk of the package could be reduced, such that greater amounts of tissue paper material may be transported, e.g., per pallet or truck.

Also, when filling a dispenser for providing tissue paper material to users there is a desire to reduce the bulk of the stack to be introduced into the dispenser, such that a greater amount of tissue paper material may be introduced in a fixed housing volume in a dispenser. If a greater amount of tissue paper material may be introduced into a dispenser, the dispenser will need refilling less frequently. This provides cost saving opportunities in view of a diminished need for attendance of the dispenser.

An example of the type of tissue to which the present disclosure relates is found in International PCT Publication No. WO 2012/087211, the content of which is incorporated herein by reference in its entirety. This document explains in detail the desire and advantages relating to increased compression of tissue stacks, the various tissue materials to which it is applicable and the relevant methods of folding and interleaving. It also describes a number of ways of compressing tissue bundles. In certain embodiments it proposes inclined belts or rollers which gradually compact a stack of tissues as they progress along a path in a continuous process. In other embodiments, one or more stacks may be compressed between plates in a batch process. Nevertheless, although it teaches that such stacks may be compressed to relatively high densities, it fails to identify certain problems that are associated with compression of the stack beyond the previously accepted pressure values.

Another example of tissue compression is given in International PCT Publication No. WO 2016/209124, the content of which is also incorporated herein by reference in its entirety. That document also describes the use of converging conveyors to compress a tissue stack in a continuous process.

Although continuous processes for compressing tissue stacks may seem acceptable in theory, in practice, such compression of loosely stacked tissues to form a compact highly compressed elongate log is not simple. The greater the compression, the greater the tendency of the upper and lower tissues to become damaged or creased due to the high pressure being applied and the inclined nature of the compressing surfaces. For a log of over 1.5 meters in length, the first part of the log may be evenly compressed, while the rear part of the log may become steadily more distorted. Such creasing is unsightly and can also affect the ease of dispensing in due course. Actual damage to the tissue may build up during a production run and eventually lead to machine failure. Compression between static plates in a batch process may alleviate some of the problems but comes at the cost of efficiency as it is more difficult to integrate into a high-speed production line.

For low volume tissue dispensers, it may be immaterial if the first or last tissue in a stack of hundreds of tissues is damaged or unsightly. In the case of bulk dispensers, there may be a desire to attach the last tissue in a bundle with the first tissue of a following bundle to ensure the continuous supply of tissues from the dispenser. This may require appropriate attachment features to be provided on the first and/or last tissues of the bundle. If this is the case, it can be essential that the upper and lower tissues in a bundle or stack are in good condition.

Thus, it would be desirable to improve methods of compressing and handling tissues to prepare same for use in dispensers.

SUMMARY

In order to achieve these technical objectives, a method is provided in one embodiment of compressing an elongate stack of folded absorbent tissues to form a tissue log. The method includes providing a stack of folded absorbent tissues having a stack length; transporting the stack along a compression path from an input end to an output end, the compression path being defined between first and second opposed transport surfaces provided on first and second compression members; and moving at least the first compression member towards the second compression member from a first spacing to a second spacing to compress the stack and form the log. The compression path has a length greater than the stack length and during compression, the stack moves along the compression path with respect to the compression members. During this process, the stack will be compressed from a first height to a second height corresponding to the second spacing.

By ensuring movement of the stack along the transport path during compression, the stack can be integrated into a production line in a continuous process. Furthermore, movement of at least the first compression member towards the second compression member from a first spacing to a second spacing to compress the stack ensures that the stack is compressed symmetrically as would be the case in a batch process, avoiding any skewing of the stack and damage to the upper and lowermost tissues. In general, movement of the stack along the compression path may be referred to as the transport direction, aligned with the length dimension of the stack. Unlike existing continuous systems with converging rollers or the like, the transport surfaces may remain parallel to each other and to the transport direction. Movement of the first compression member will take place in a compression direction corresponding to a height dimension of the stack and being generally perpendicular to the transport direction. Guides may be provided at the sides of the stack to guide it in the width direction, it being understood that the width dimension of the stack will generally not change significantly during the step of compression to form the log. Allowance may be made for variation of the bundle width of up to 10%.

In the following, reference will be made to a process and apparatus in which the stack moves horizontally and only the first compression member moves vertically. It will however be understood that the process may be implemented in alternative configurations with movement taking place vertically or at an angle and with compression from either or both directions. Furthermore, reference to the log is intended to refer to the stack in its compressed state.

In an embodiment the first and second transport surfaces include conveyor belts carried by the first and second compression members, and the method includes driving the conveyor belts to transport the stack along the compression path. By driving the transport surfaces in engagement with the stack, it may be ensured that the upper and lowermost tissues experience no relative movement as they are compressed with respect to the transport surface which actually performs the compression.

Since the movement of the first compression member from a first spacing to a second spacing requires a finite time, the length of the compression path is preferably longer than the stack by an amount that at least corresponds to the distance moved by the stack during the compression stroke. The compression path may be longer than 2 meters or longer than 2.4 meters or even longer than 2.75 meters. It will also be understood as desirable for the first compression member to commence movement towards and into engagement with the stack only after the stack is fully located in the compression path. It will be understood that a portion of the input end may be slightly flared or rounded if this is desired to assist entry of the trailing end of the stack before the compression stroke is completed.

It will also be understood as desirable that the first compression member is moved to a position corresponding to the second spacing before a leading end of the log exits the compression path. Reference is given here and above to a second spacing. It will be understood that this spacing may either be defined or variable depending upon the implementation of the system for moving the compression member. This may move the compression member to an absolute position, e.g., against a fixed stop or may move it based on a required final pressure. In one embodiment, the movement is defined by a final pressure and the actual spacing achieved will vary within tolerances, depending on other factors such as tissue construction and speed of operation.

In one embodiment, the first compression member includes a plurality of compression elements aligned along the compression path between the input end and the output end and moveable at least partially independently of one another. The method may further include moving a first compression element located closest to the input end from the second spacing back towards the first spacing once a trailing end of the log has been transported past the first compression element. The first compression member may include any number of compression elements depending upon the chosen construction and on the length of the stack. It will be understood that the second compression member may also include a plurality of compression elements if that is desired. For example, one, two, three, four, five or more compression elements may be provided.

By dividing the compression member into a plurality of compression elements it is possible to open part of the compression path for entry of a subsequent stack while the compressed log is still located in another part of the compression path. The method may then include transporting a subsequent stack of folded absorbent tissues into the input end of the compression path before the trailing end of the log has exited the output end of the compression path. In this manner a greater throughput of tissue stacks may be achieved.

The method may be applied to any suitable stack of tissues for which high compression into a log is required. As discussed above, it is especially applicable to stacks in which the integrity of the upper and/or lowermost tissue is important. According to one embodiment, the method may further include applying an attachment strip to an upper and/or lower tissue of the stack prior to delivering the stack to the compression path. During transport of the stack through the compression path and compression of the stack, the attachment strip may be engaged by the transport surfaces without damage thereto. The attachment strip may be applied to the stack in a continuous process whereby the stack travels at a speed corresponding to the speed of the stack through the compression path.

The method may also include wrapping the log in a web or webs to maintain the compression after leaving the compression path. This step may include delivering the log from the compression path to a bander apparatus and wrapping it in wrapping web. The bander apparatus may be largely conventional although designed to operate at high compression. One bander apparatus is described in International PCT Publication No. WO 2006/041435, the contents of which are hereby incorporated by reference in their entirety. The web material may be adhered to itself by any appropriate means, including adhesive, heat sealing or additional elements such as tape and should be strong enough to withstand the spring-back pressure exerted by the log. To this end, high-tensile paper such as virgin-pulp based paper having a weight of at least 70 gsm, preferably at least 90 gsm and even over 100 gsm and a tensile strength in a direction along the height of the stack of at least 3.5 $kN/m^2$, preferably at least 4.5 $kN/m^2$, most preferred at least 5.5 $kN/m^2$.

The bander apparatus may be engaged directly with the output end of the compression path. Thus, it maintains the log at a compression corresponding to that at the output end of the compression path, thus increasing the period of compression. The bander apparatus may be provided with conveyor belts for transporting the log through the bander apparatus with the conveyor belts having a spacing corresponding to the second spacing of the first and second compression members. It will be understood that this spacing may be adjusted as required, depending on whether it is desired to increase or decrease the compression of the log during wrapping. The log may be transported through the bander apparatus at a constant speed, which may correspond to the speed through the compression path. It may also be desirable to include a holding station that retains the pressure on the log even after the wrapping is completed. In one embodiment, the bander apparatus, including the holding station has a length of greater than 3 meters, preferably greater than 4 meters and even greater than 5 meters to ensure adequate time for the log to pass through the bander apparatus under the desired pressure.

The method may further include cutting the log e.g. by sawing, into a plurality of individual tissue bundles. A typical log will have a length of more than 1.5 meters, typically from around 1.8 meters to 2.6 meters and may be cut into from 8 to 15 individual bundles, although it will be understood that this will depend upon the actual width of tissue required. The step of cutting may take place subsequent to wrapping the log although it is not excluded that the log is first cut and then wrapped. This step may also take place in a continuous process or in a batch process (one log at a time) or an incremental process (one bundle at a time).

As indicated above, the method is particularly applicable in the case of high pressures. These are pressures that compress tissue to the limits that can be achieved without denaturing the product. The method is particularly applicable to the case where the stack is compressed with a pressure of greater than 120 $kN/m^2$, preferably greater than 160 $kN/m^2$ and optionally greater than 225 $kN/m^2$. In certain circumstances, for particular tissue structures, pressures of between 300 $kN/m^2$ and 600 $kN/m^2$ may be required. It will be noted that the pressure values quoted here and below are calculated average values based on the machine construction and the forces encountered at the machine. Actual values encountered within the tissue will be transitory and may vary from these averaged values.

The pressures referenced above may be maintained for a considerable period of time as the log proceeds through the compression path and or any subsequent holding station that retains the pressure. In certain embodiments the pressure may be maintained for at least 2 seconds for any particular portion of the log. Depending upon the length of the compression path and/or holding station, the pressure may be maintained for at least 4 seconds or more than 6 seconds or more than 8 seconds.

Furthermore, the method is applicable to any sort of tissue that may require compression or wrapping as herein described. It is however particularly applicable to tissues that are intended for use in bulk tissue dispensers. The term "tissue" is herein to be understood as a soft absorbent paper having a basis weight below 65 $g/m^2$, and typically between 10 and 50 $g/m^2$. Its uncompressed density is typically below 0.30 $g/cm^3$, preferably between 0.08 and 0.20 $g/cm^3$. The fibres contained in the tissue are mainly pulp fibres from chemical pulp, mechanical pulp, thermo-mechanical pulp, chemo-mechanical pulp and/or chemo-thermo-mechanical pulp (CTMP). The tissue may also contain other types of fibres enhancing, e.g., strength, absorption or softness of the paper. The absorbent tissue material may include recycled or virgin fibres or a combination thereof.

In accordance with some embodiments of the method, the absorbent tissue material may be a dry crepe material, a structured tissue material, or a combination of at least a dry crepe material and at least a structured tissue material. A structured tissue material is a three-dimensionally structured tissue paper web. The structured tissue material may be a TAD (Through-Air-Dried) material, a UCTAD (Uncreped-Through-Air-Dried) material, an ATMOS (Advanced-Tissue-Molding-System), an NTT material (New Tissue Technology from Valmet Technologies) or a combination of any of these materials. A combination material is a tissue paper material comprising at least two plies, where one ply is of a first material, and the second ply is of a second material, different from said first material.

Optionally, the tissue paper material may be a hybrid tissue. In the present application, this hybrid tissue is defined as a combination material comprising at least one ply of a structured tissue paper material and at least one ply of a dry crepe material. The ply of a structured tissue paper material may be a ply of TAD material or an ATMOS material. The combination may consist of structured tissue material and dry crepe material, and preferably consist of one ply of a structured tissue paper material and one ply of a dry crepe material, for example the combination may consist of one ply of TAD or ATMOS material and one ply of dry crepe material. An example of TAD is known from U.S. Pat. No. 55,853,547; ATMOS from U.S. Pat. Nos. 7,744,726 and 7,550,061 and 7,527,709; and UCTAD from EP Patent No. 1156925.

Optionally, a combination material may include other materials than those mentioned in the above, such as for example a nonwoven material. Alternatively, the tissue paper material may be free from nonwoven material.

The tissue may be compressed from an initial density in the stack to a final density in the log. In the following reference to the final density is understood to be the density of a wrapped log after spring back against the wrapper has occurred. The stack may thus be compressed to a slightly higher density and on relaxing against the wrapper, will assume a slightly lower density. The compressed density at the termination of the compression step may be 4% to 40% higher than the wrapped density after spring-back, depending upon the arrangement and effectiveness of the wrapping operation. In one embodiment, this over-compression may be around 15-25%.

The final density will also depend upon the sort of tissue that is being packaged. In one embodiment, the tissues are of structured tissue and the final density is greater than 0.2 $g/cm^3$, optionally greater than 0.25 $g/cm^3$ and even greater than 0.3 $g/cm^3$. In another embodiment, the tissues are of hybrid tissue and the final density is greater than 0.25 $g/cm^3$, optionally greater than 0.3 $g/cm^3$ and even greater than 0.4 $g/cm^3$. In a further embodiment, the tissues are of dry crepe tissue and the final density is greater than 0.3 $g/cm^3$, optionally greater than 0.35 $g/cm^3$ and even greater than 0.45 $g/cm^3$. In most cases it will be greater than 0.3 $g/cm^3$, optionally greater than 0.4 $g/cm^3$ and even greater than 0.5 $g/cm^3$.

In one embodiment, the stack is compressed to a log having a height that is less than 70% of the initial stack, preferably less than 60% and optionally even less than 50% of the initial loose stack.

The folded tissues may be provided in any appropriate format as required by the end user. Most typically, the folded tissues will be interleaved, in order to facilitate dispensing. They may be interleaved in a V, M or Z configuration. In a particular embodiment, the tissue is present as two continuous webs provided with offset perforations whereby tissues are dispensed alternately from each web.

In one embodiment, the method may be carried out such that the stack is transported through the compression path at a speed of greater than 0.3 m/s. Speeds of greater than 0.5 m/s may be achieved and even up to 0.7 m/s or greater. The movement of the compression member from the first spacing to the second spacing, otherwise referred to as the compression stroke, may be around 10 cm. The stroke may be achieved in about 1 second. by which it will be understood that the stack advances a distance corresponding to its speed, namely 0.3, 0.5 or 0.7 meter for the exemplary speeds given above.

According to another embodiment, a compression apparatus is described for compressing an elongate stack of folded absorbent tissues to form a tissue log. The apparatus includes: first and second opposed compression members, the compression members being spaced from one another and provided with respective first and second transport surfaces defining a compression path therebetween, the transport surfaces being operable to transport a stack along the compression path from an input end to an output end; and an actuator mechanism for moving the first compression member towards the second compression member from a first spacing to a second spacing to form the log, while continuing to transport the stack relative to the compression members along the compression path.

According to one embodiment, the first transport surface is parallel to the second transport surface. They will also be parallel to the compression path and it will thus be understood that compression takes place by movement of the compression members towards each other rather than by movement of the stack in the transport direction.

According to another embodiment, at least the first transport surface includes a conveyor belt. It will be understood that in most embodiments the second transport surface will also have a conveyor belt although they may be distinct from one another in design.

As described above, the first compression member may include a plurality of compression elements aligned along the compression path between the input end and the output end. In that case, the compression elements may be provided with overlap portions which overlap each other such that the first compression member is effectively continuous between adjacent compression elements.

In an embodiment, the compression elements each have two or more parallel conveyor belts extending side by side, which all together form the transport surface. The overlap portions may extend along the compression path between the conveyor belts. In fact the compression elements may include stationary rail elements on either side of the conveyor belts, lying flush with the surface of the conveyor belts or slightly recessed, which extend to become the overlap portions.

Any suitable actuator mechanism may be provided to cause movement of the first compression member towards the second compression member. Such actuator mechanism should be capable of exerting the high pressures required in a controlled and repeatable manner. The compressive force may be provided by hydraulic or pneumatic rams, solenoids, electric motors, springs or the like either directly or through a mechanical linkage or screw mechanism. In one embodiment the actuator includes an actuator motor and screw mechanism. In the case of a plurality of compression elements a plurality of actuators may be provided for independently moving the plurality of compression elements between the first spacing and the second spacing.

The apparatus may also have a controller adapted to control operation of the apparatus as described above or hereinafter. The controller may provide for the co-ordination of the respective movements to ensure the desired results based on feedback from appropriate sensors.

Another embodiment of this invention relates to a packaging system including a compression apparatus in combination with a bander apparatus aligned with the second end of the compression path for receiving the log and wrapping it in a wrapping web. The bander apparatus may include a transport path having a height corresponding to the second spacing whereby the log can be transported from the compression path through the transport path without loss in compression. In this context it will be understood that the transport path may be marginally different in height to the second spacing to either slightly increase compression prior to wrapping or to slightly relax the compression in the log.

The system may also have a saw or the like for cutting the log into individual tissue bundles. The saw may be a conventional circular log saw or band saw located downstream of the compression apparatus or preferably downstream of the bander apparatus.

The system may also include an attachment applying apparatus aligned with the first end of the compression path, for application of attachment elements to an upper and/or lower tissue of the stack prior to delivering the stack to the compression path. The attachment elements may be provided as individual elements or as part of an attachment strip. The attachment elements may be any suitable elements that can allow the last tissue of one bundle to be engaged with the first tissue of a subsequent bundle. They may include hook and eye fasteners, double-sided tape, envelope or cold-seal adhesive or the like. In one embodiment, an attachment strip is applied having hook and eye type fasteners that is applied over the full length of the stack on both upper and lower surfaces.

The system may be arranged at an output of a tissue converting machine having an interfolder for receiving the stack of folded tissues from the interfolder and delivery to the compression path.

Embodiments of the invention also relate to a tissue bundle including a stack of interleaved absorbent tissues, wrapped in a wrapper to form a tight final bundle and compressed as described above or hereinafter; with the upper and/or lower tissues being provided with attachment elements for engaging the tissues of two bundles to form a continuous tissue supply. The bundle preferably has a final density, which for structured tissues is greater than 0.2 $g/cm^3$, optionally greater than 0.25 $g/cm^3$ and even greater than 0.3 $g/cm^3$. For hybrid tissue the final density may be greater than 0.25 $g/cm^3$, optionally greater than 0.3 $g/cm^3$ and even greater than 0.4 $g/cm^3$. In the case of dry crepe tissue, the final density may be greater than 0.3 $g/cm^3$, optionally greater than 0.35 $g/cm^3$ and even greater than 0.45 $g/cm^3$.

The tissue bundle may be distinguished in various ways from existing bundles. Not only is it more highly compressed but it is also more consistently compressed along its length. Furthermore, as a result of the re-wrapping step, the initial supporting wrapper may be nipped to tightly wrap the bundle and to maintain the final density.

Other advantages and distinctions of embodiments of the present invention over existing methods and products will be apparent in the light of the following detailed description.

BRIEF DESCRIPTION OF THE DRAWINGS

The features and advantages of the invention will be appreciated upon reference to the following drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
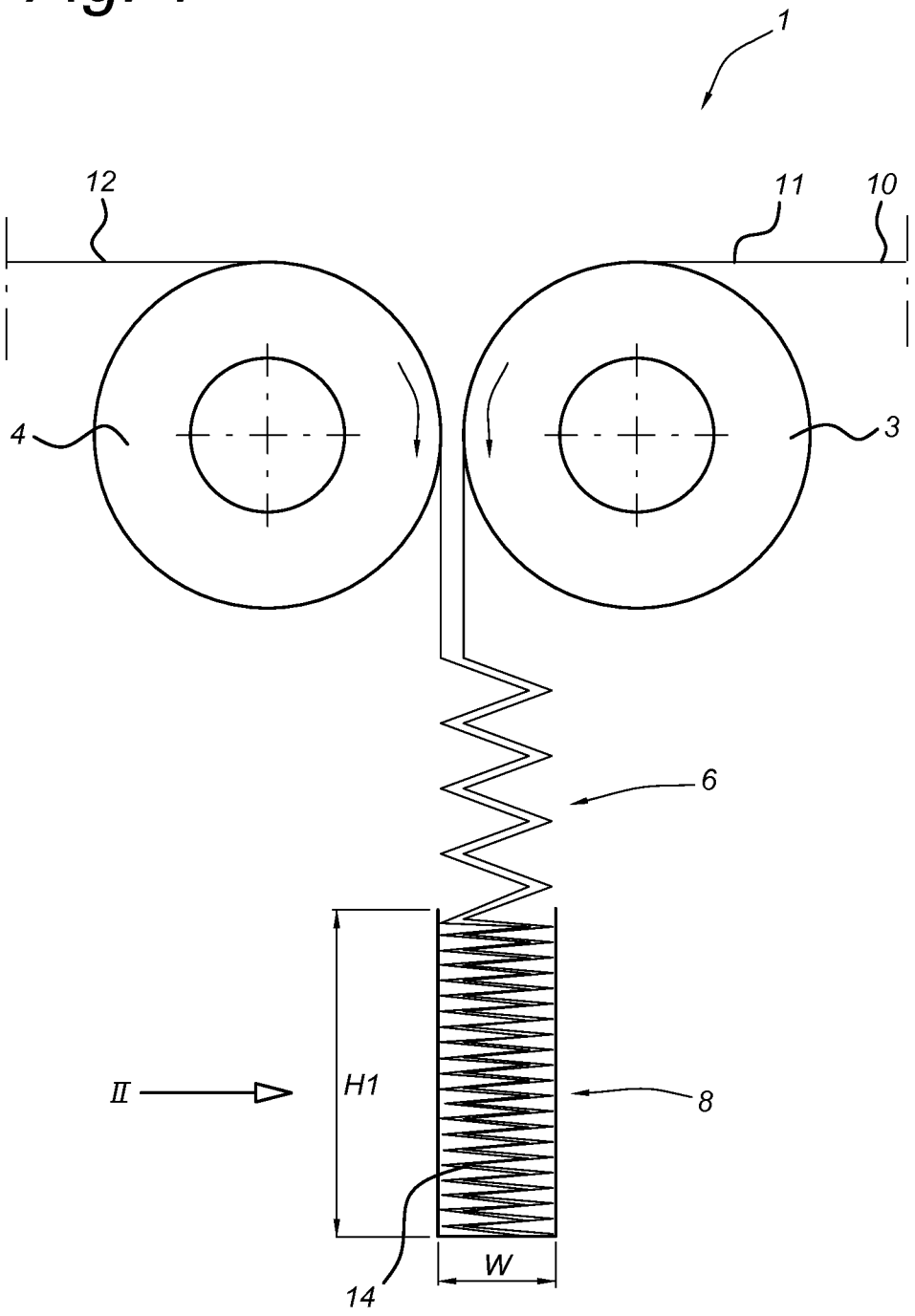
FIG. 1 is a schematic side view of an output part of a conventional tissue converting machine.

FIG. 1 is a schematic side view onto an output part of a conventional tissue converting machine 1 that may be used in conjunction with a packaging system and compression apparatus as described in this application. In this embodiment, the converting machine 1 is for the production of 2-ply dry-crepe tissue 10 according to the SCA article number 140299, each of the plies being 18 gsm. The skilled person will nevertheless understand that any other suitable tissue may also be used.

The converting machine 1 provides its output as two webs 11, 12 of tissue 10, that are passed around output rollers 3, 4, partially cut to define individual tissue lengths and folded together at interfolder 6. The tissue 10 coming from the respective webs 11, 12 is folded together in Z-formation, with folds of the respective webs 11, 12 interleaved together as is otherwise well known in the art. The partial cuts are offset from each other in the respective webs such that the folded tissue web is continuous and, when drawn from a dispenser, tissues from each web will be dispensed alternately. The folded tissue 10 is collected as a stack 14 in stacking station 8 until the stack reaches an uncompressed height H1, which in this case is around 130 mm. The stack 14 has a stack width W, which in this case is around 85 mm, being a standardized dimension for use in certain tissue dispensers. These dimensions can of course be adjusted according to the tissue material, the process and/or the required end use.

Figure 2:
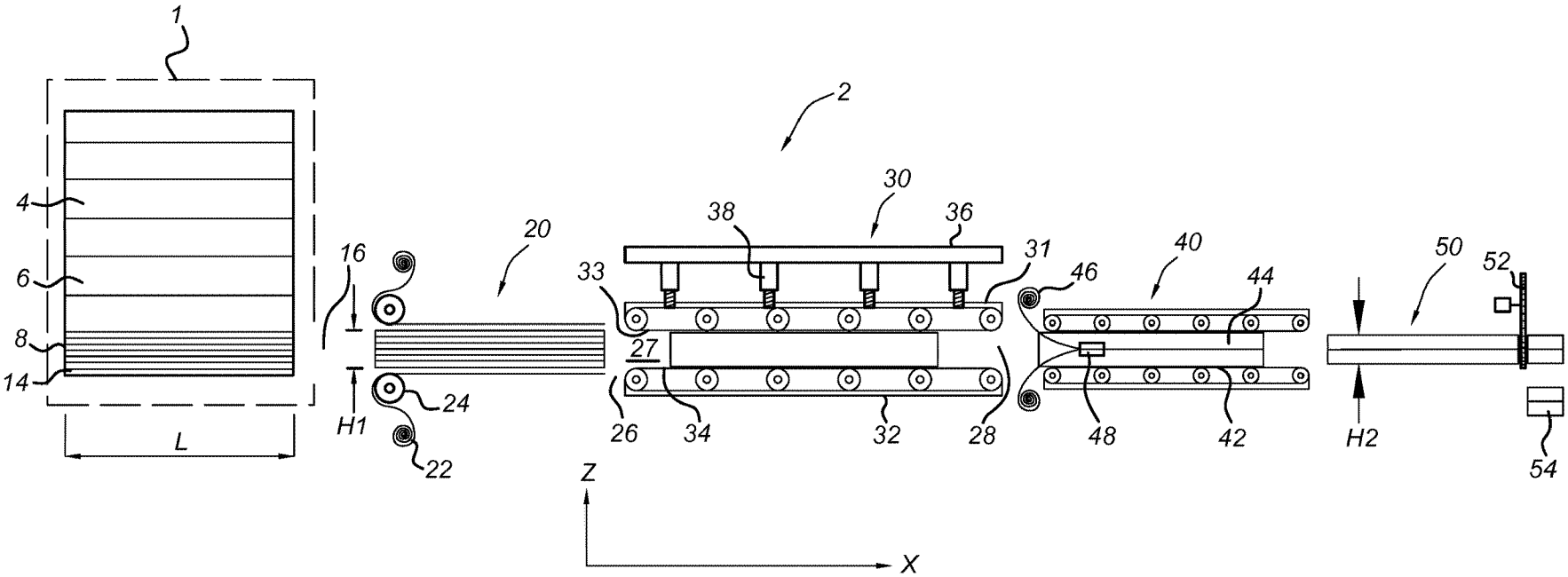
FIG. 2 is a schematic view of the converting machine of FIG. 1 and a packaging system according to one embodiment.

FIG. 2 is a schematic view in the direction II of FIG. 1, in the process direction of the converting machine 1. According to FIG. 2, the roller 4 is shown above the interfolder 6 and the stacking station 8. The tissue webs 11, 12, the rollers 3, 4, the interfolder 6 and the stacking station 8 all have an effective width L, which defines the length of the stack 14. In the present embodiment, this length L is 2200 mm although the skilled person will understand that this is a variable that will be determined by the machine and/or the end use.

Aligned with the stacking station 8, is a packaging system 2 for packaging of the converted tissue produced by the converting machine 1. The packaging system 2 includes a number of apparatus arranged in sequence in a transport direction X and aligned with the stacking station 8 for handling and packaging of the stack 14 in an effectively continuous process. It will be understood that the converting machine 1 and packaging system 2 are both complex installations having many more components that are neither shown nor discussed as they are otherwise not relevant to the present invention.

Aligned with an outlet 16 of the converting machine 1, there is an attachment applying apparatus 20 comprising a supply of attachment elements 22 and application heads 24. The attachment applying apparatus 20 is in turn aligned with an input end 26 of compression apparatus 30. Compression apparatus 30 includes first and second opposed compression members 31, 32, which define a compression path 27, each of which carries respective first and second transport surfaces 33, 34. The first compression member 31 is mounted to be movable in a vertical direction Z and an actuator mechanism 36 comprising a plurality of actuators 38 is arranged for moving the first compression member 31 towards and away from the second compression member 32.

An output end 28 of the compression apparatus is aligned with a bander apparatus 40 having a transport path 42 for a compressed log 44 and which is provided with a supply of wrapping web 46 and an adhesive applicator 48. The bander apparatus 40 is in turn aligned with a saw station 50, comprising an otherwise conventional circular saw 52, arranged to cut individual bundles 54 from the log 44. The log 44 has a final height H2, which is significantly less than the uncompressed height H1.

Operation of the packaging system 2 in the packaging of tissue bundles will now be described with reference to FIG. 2.

A tissue stack 14 is collected in the converting machine 1 until the stack 14 reaches an uncompressed height H1, at which point the tissue webs 11, 12 are broken and the stack 14 is moved out of the outlet 16 and into the attachment applying apparatus 20. As indicated above, additional rollers, grippers, guides, sensors, actuators, drives and transport provisions will be present to facilitate this movement. Such provisions are conventional and are not further discussed in this context.

As the tissue stack 14 passes in the transport direction X through the attachment applying apparatus 20, the uppermost tissue and the lowermost tissue of the stack 14 are engaged by application heads 24, which apply attachment elements 22 to these surfaces. The attachment elements 22 are provided on a continuous attachment strip having a self-adhesive surface that adheres to the tissue material. In this embodiment, the attachment elements 22 on the upper and lower surfaces of the stack 14 are identical hook and eye type fasteners, such that there will be no need to orientate a bundle 54 in use.

From the attachment applying apparatus 20, the stack 14 proceeds in the transport direction X to the compression apparatus 30 and enters the compression path 27 via the input end 26. So that the stack 14 can enter the compression path 27, the first compression member 31 should be spaced from the second compression member 32 by a spacing that is greater than the uncompressed height H1 of the stack 14. To this purpose, the actuators 38 have been operated to withdraw the first compression member 31 in the Z direction.

Once the stack 14 is completely within the compression path 27, the actuators 38 are operated to move the first compression member 31 in the Z direction towards the second compression member 32. This movement proceeds until the first compression member 31 is spaced from the second compression the actuators 38 may be operated to move the first compression member 31 until a certain pressure is achieved. This pressure may be around 160 $kN/m^2$, according to requirements. The spacing at this time may be less than H2, allowing for some spring-back of the tissue material once the pressure is removed. During the compression stroke, the respective first and second transport surfaces 33, 34 move the stack 14 along the compression path 27 from the input end 26, to the output end 28. Once compressed in this state, the stack 14 is referred to in the following as a log 44.

On exiting the output end 28 of the compression apparatus 30, the log continues to move in the transport direction Z into the bander apparatus 40. The bander apparatus 40 may be otherwise conventional apart from its adaptation to handle relatively highly compressed logs. The log 44 leaving the compression path 27 has a tendency to recover to a greater height, and the transport path 42 through the bander apparatus 40 should therefore maintain this compression until the wrapping web 46 has been applied. The wrapping web 46 is applied around the log 44 from upper and lower web dispensers as a two-part wrapper, joined to each other along a longitudinal seam by a hotmelt adhesive. It will be understood that a one-part wrap-around wrapper could alternatively be used. The wrapper material is of virgin paper with a surface weight of 110 gsm, which is somewhat stronger than a wrapper conventionally used for loose bundles of similar weight.

The wrapped log 44 on exit from the bander apparatus 40 has a final height H2 of around 100 mm and a final density of around 35 g/cm$^3$. At this value, the tissue material is still viable and once dispensed has all of the properties expected of it and from a user perspective is identical to tissue material exiting the converting machine 1. The log 44 no longer needs to be maintained in compression since the wrapping web 46 prevents expansion. The log 44 proceeds to saw station 50 where circular saw 52 cuts individual bundles 54 from the log 44. This portion of the operation may take place offline or out of line with the other operations of the packaging system 2. The saw 52 may be designed to operate with intermittent advancement of the log 44, while the log 44 may proceed at a constant speed through the attachment applying apparatus 20, the compression apparatus 30 and the bander apparatus 40.

Figure 3:
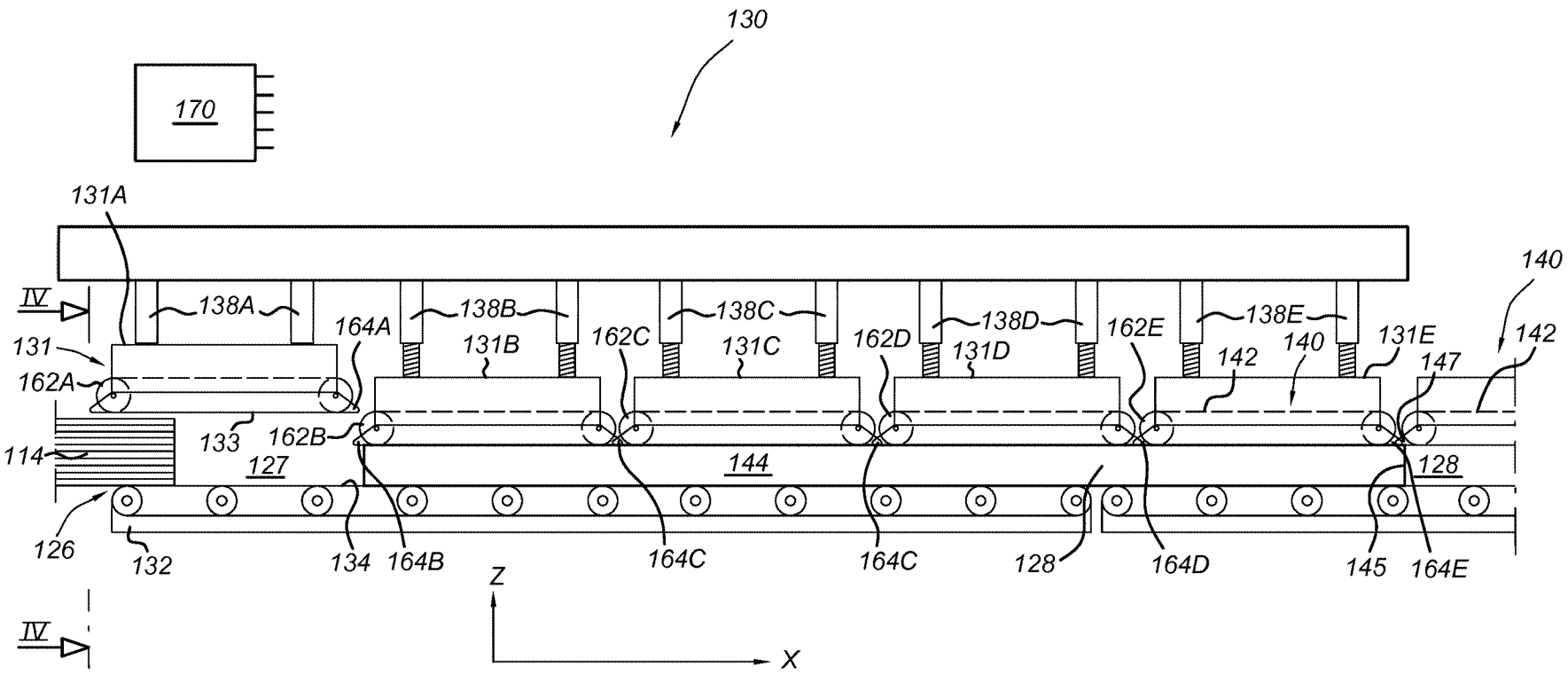
FIG. 3 is a schematic view of a second embodiment of a compression apparatus.

A second embodiment of a compression apparatus 130 is shown in FIG. 3. Compression apparatus 130 may replace the compression apparatus 30 in the packaging system 2 of FIG. 2. Like elements from that embodiment are designated with the same reference numerals preceded by 100.

The compression apparatus 130 of the second embodiment differs from the previous embodiment in that the first compression member 131 is formed in five separate sections by compression elements 131 A-E. Each compression element 131 A-E has its own section of the first transport surface 133 formed by conveyor belts 162 A-E. In this embodiment, the second compression member 132 and the second transport surface 134 are constructed as a continuous element as in the first embodiment although it will be understood that they could also be interrupted.

Each compression element 131 A-E is provided with its own pair of actuators 138 A-E, which are individually controlled by a central controller 170, which may be the controller for the whole packaging system 2. The controller 170 is also operatively connected to the respective transport surfaces 133, 134 and is thus able to control the relative movements and speeds and pressures of all of the components of the compression apparatus 130.

The compression elements 131 A-E are also provided with overlap portions 164 A-E, which extend in the transport direction Z beyond the respective conveyor belt 162 A-E. In fact, as can be seen in FIG. 3, the overlap portions 164C on the third compression element 162C overlap with those of both the second compression element 162B and the fourth compression element 162D. In this manner, the first compression member 131 is effectively continuous between adjacent compression elements 131 A-E and the compression path 127 through the compression apparatus 130 is continuous.

Also shown in FIG. 3 is a portion of bander apparatus 140. The transport path 142 of the bander apparatus 140 is also provided with overlap portions 147 which overlap with the overlap portions 164E of the fifth compression element 162E. In this manner the compression path 127 is also continuous with the transport path 142. A stack 114 is entering the input end 126 of the compression path 127 and a log 144 is leaving the output end 128 and entering the transport path 142.

Figure 4:
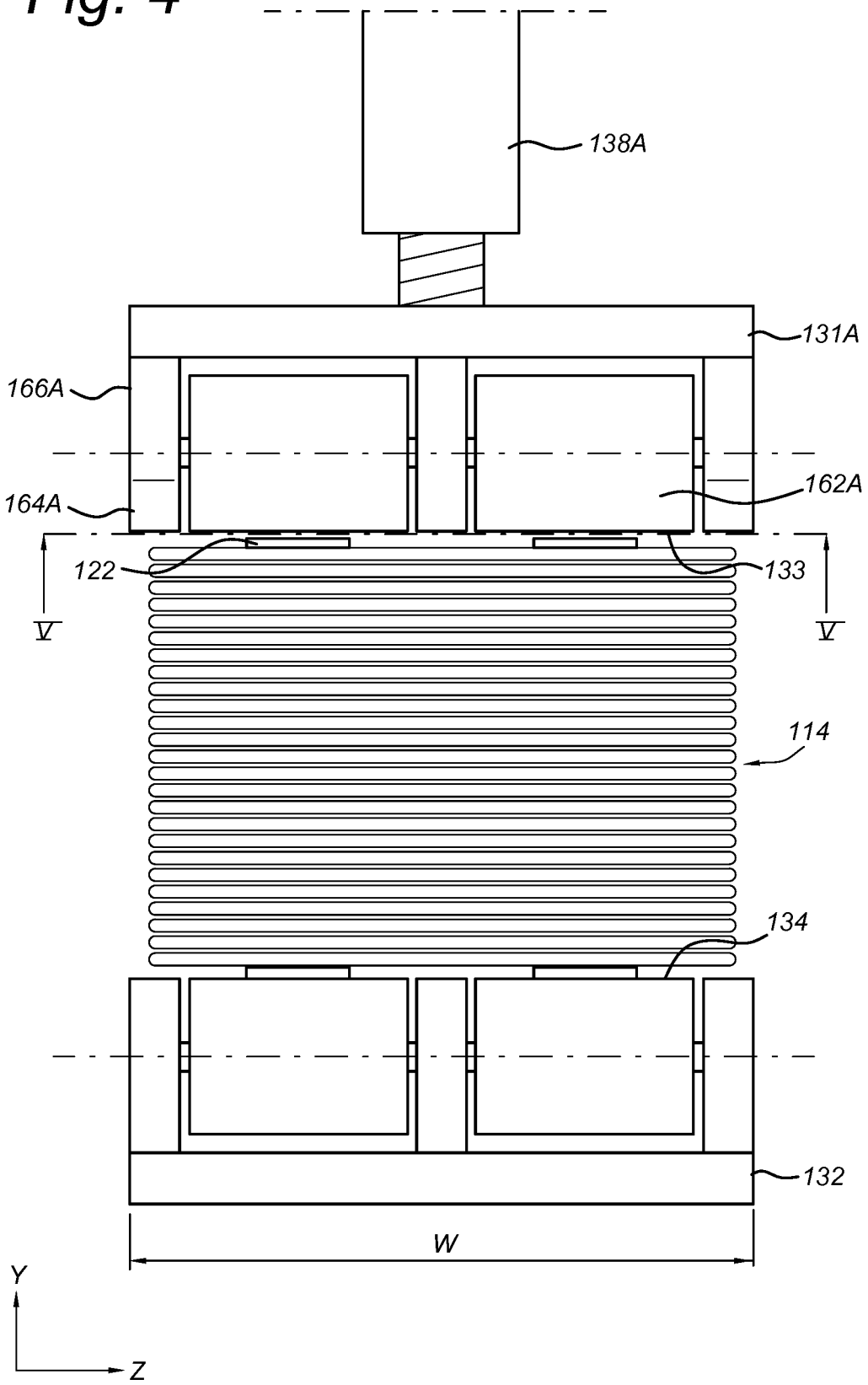
FIG. 4 is a cross section view of one portion of the compression apparatus of FIG. 3 taken along the direction IV-IV shown in FIG. 3.

FIG. 4 is a section through the stack 114 along line IV-IV of FIG. 3, looking in the transport direction X. As can be seen in this view, the stack has a width W. Compression element 131A can be seen in end view to have a pair of conveyor belts 162A aligned side by side between three rail elements 166A positioned on either side of both conveyor belts 162A. The rail elements 166A, form part of the structure of the compression element 131A, supporting the conveyor belts 162A for rotation and providing structural support for the conveyor drive (not shown). The lower surfaces of the rail elements 166A lie flush with the transport surface 133 formed by the conveyor belts 162A. At their lower portions too, the rail elements 166A extend to become the overlap portions 164A.

Also visible in FIG. 4, on the uppermost tissue of the stack 114 are attachment elements 122. Similar attachment elements 122 are also adhered to the lowermost surface of the stack in engagement with the second transport surface 134 of the second compression member 132. The second transport member 132 is similar in section to the first transport member 131 apart from the fact that it is not divided into individual transport elements.

Figure 5:
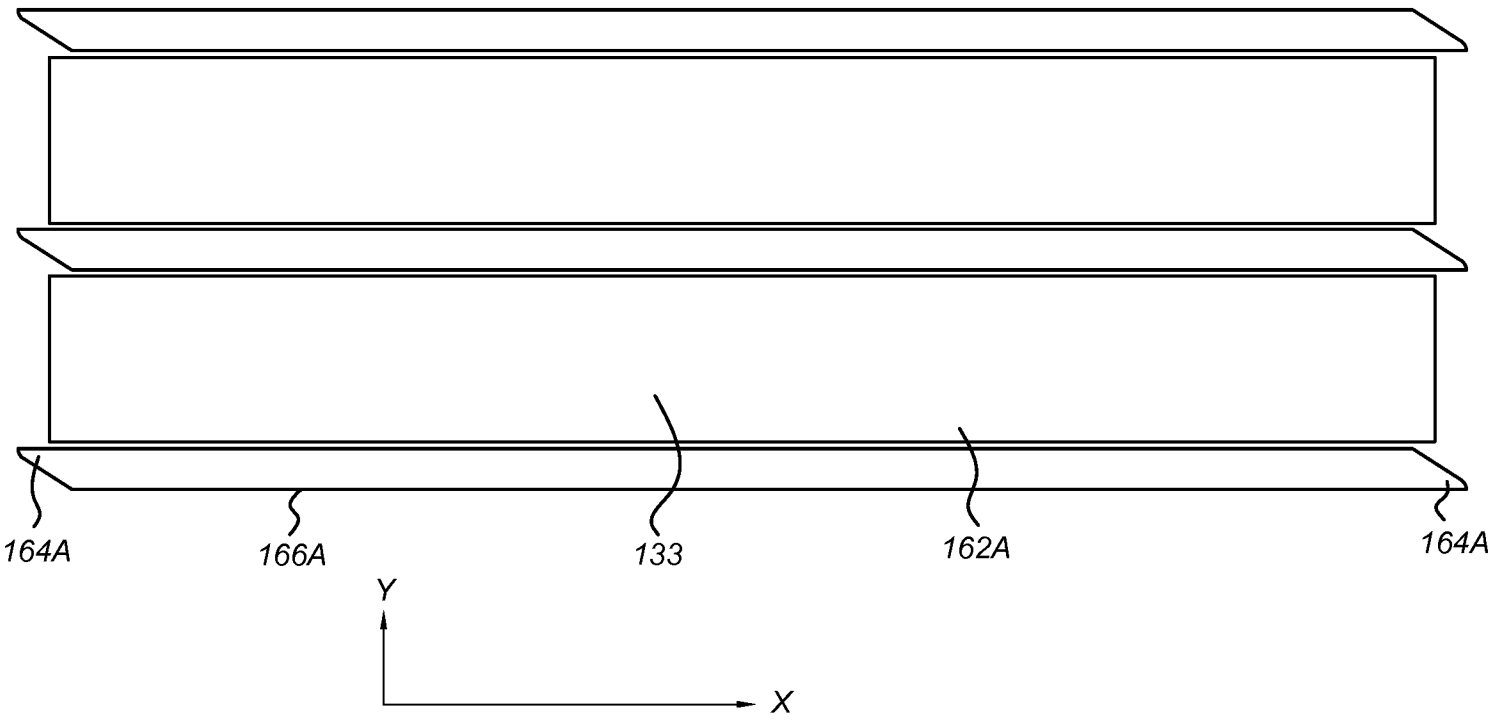
FIG. 5 is an upwardly-facing view of a compression surface of the compression element of FIG. 4 taken along the direction V-V shown in FIG. 4.
Figure 6:
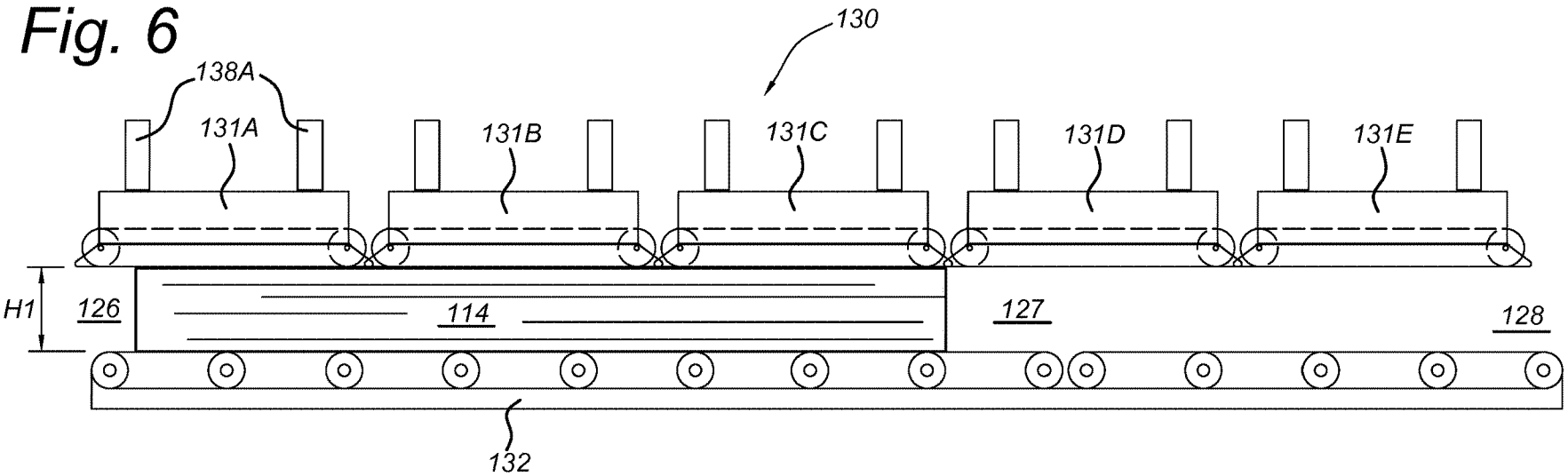
FIG. 6 is a schematic view of the compression apparatus of FIG. 3 in one stage of operation.

FIG. 5 is a view onto the transport surface 133 of the first compression element 131A in the direction V-V of FIG. 4. In this view, the extent of the rail elements 166A in the transport direction X can be seen between the overlap portions 164A at their respective ends. Conveyor belts 162A can also be seen.

Operation of the compression apparatus 130 of FIGS. 3 to 5 will now be described with reference to FIGS. 6 to 9, to the extent that it differs from that of the first embodiment. In an initial stage of operation shown in FIG. 6, the compression path 127 is opened completely with all of the compression elements 131 A-E fully withdrawn. In this situation, a stack 114 having an uncompressed height H1, can enter the compression path 127 from the input end 126 and is shown located beneath the first three compression elements 131A-C.

Figure 7:
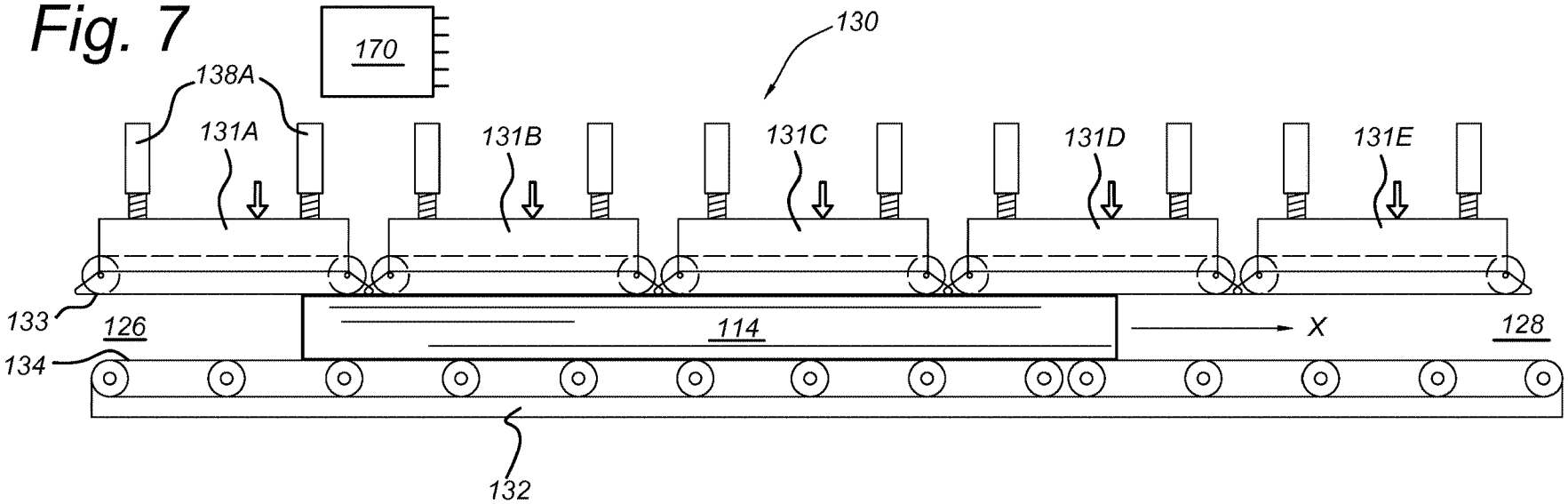
FIG. 7 is a schematic view of the compression apparatus of FIG. 6 in another stage of operation.

In FIG. 7, the compression stroke begins and all of the compression elements 131 A-E start to move downwards together towards the second compression member 132 under the control of the controller 170. During the compression, the stack 114 continues to move forwards, transported in the transport direction X by the transport surfaces 133, 134.

Figure 8:
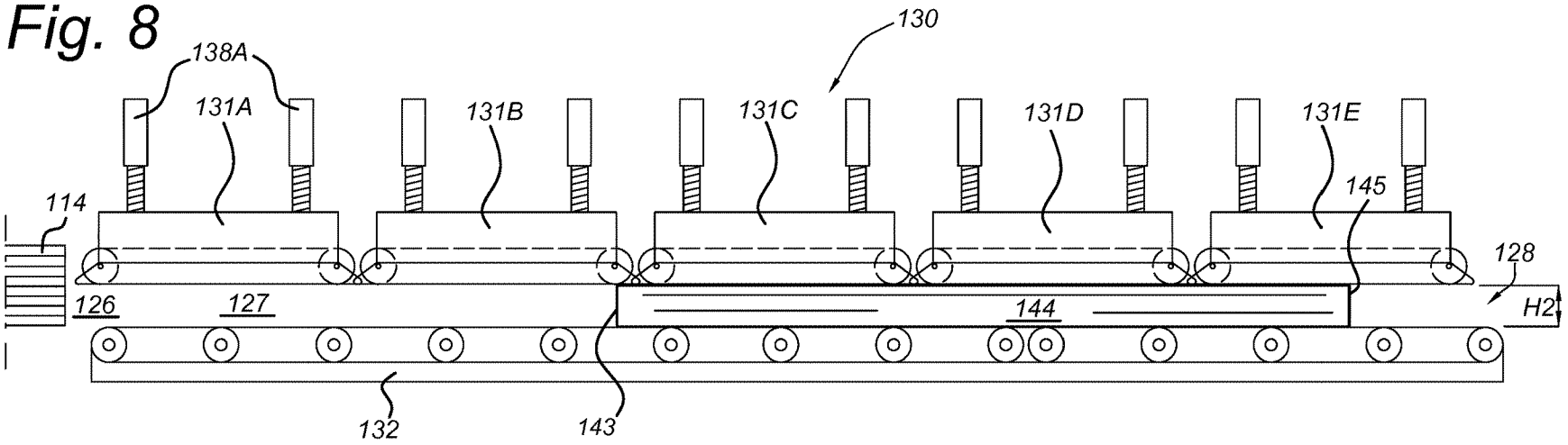
FIG. 8 is a schematic view of the compression apparatus of FIG. 6 in a further stage of operation.

In FIG. 8, compression is complete and the compression elements 131 A-E are at a second spacing with respect to the compression member 132, corresponding (approximately) to the final height H2 of the log 144. By now however the log 144 has progressed to a position under the fifth compression element 131D with its leading end 145 at the output end 128 of the compression path 127. The trailing end 143 of the log 144 has now passed the first compression element 131A, which is actuated to withdraw by the controller 170.

As previously shown in FIG. 3, once the first compression element 131A has withdrawn, a new stack 114 can enter the compression path 127.

Figure 9:
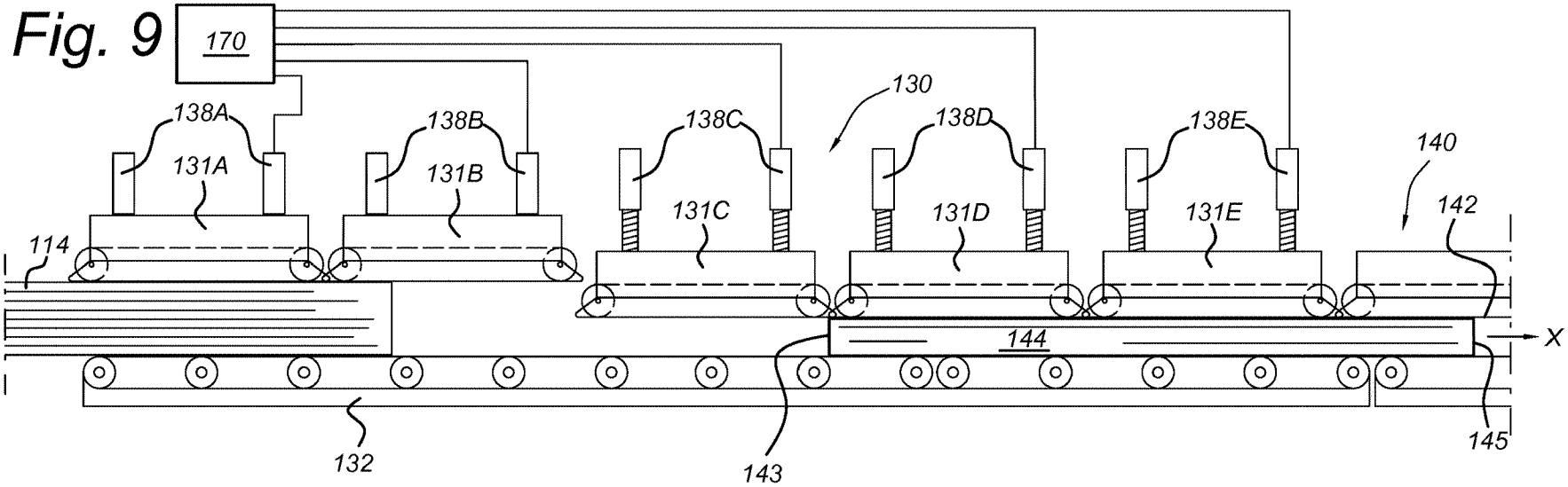
FIG. 9 is a schematic view of the compression apparatus of FIG. 6 in yet another stage of operation.

FIG. 9, shows schematically the compression apparatus 130 in a further step, together with a portion of the bander apparatus 140. The log 144 has been transported further in the transport direction X through the output end 128 of the compression apparatus 130 and into the transport path 142 bander apparatus 140. As the trailing end 143 of the log 144 passes each of the compression elements 131 A-E in sequence, the controller 170 actuates the respective actuator 138 A-E to withdraw the respective compression element 131 A-E. In FIG. 9, the second compression element 131B has also been withdrawn and the stack 114 has moved forwards under it.

It will be noted in the above that all of the compression elements 131 A-E move downwards together in the compression stroke. Retraction or withdrawal of each compression element 131 A-E takes place one at a time i.e. incrementally as the trailing end 143 of the log 144 passes the respective compression element. This allows a greater throughput of tissue stacks 114, since there is no necessity for a log to completely clear the compression apparatus 130 before a subsequent stack 114 enters. Once compressed, the log 144 remains compressed as it transports into the transport path 142 of the bander apparatus 140. It will be understood that although the compression elements 131 A-E are shown retracting individually, one at a time, it is also possible to retract them in groups, namely 131A, B together followed by 131C, D, E. It is also possible that only compression element 131A needs be retracted individually to achieve the desired throughput with the remaining compression elements 131 B-E retracted together. It will also be understood that different numbers of compression elements may be provided and that they may be different from each other in length.

It will be recognized that while the invention has been described by reference to the embodiments discussed above, these embodiments are susceptible to various further modifications and alternative forms well known to those of skill in the art, without departing from the scope of the invention. Accordingly, although specific embodiments have been described, these are examples only and are not limiting upon the scope of the present application. It is intended that the specification and examples be considered as exemplary only. Many additional variations and modifications are possible and are understood to fall within the framework of the disclosure.

What is claimed is:

1. A method of compressing an elongate stack of folded absorbent tissues to form a tissue log, the method comprising:

providing a stack of folded absorbent tissues having a stack length;

transporting the stack along a compression path from an input end to an output end, the compression path being defined between first and second opposed transport surfaces provided on first and second compression members; and moving at least the first compression member towards the second compression member from a first spacing to a second spacing to compress the stack and form the log, wherein the stack is compressed with a pressure of greater than 120 kN/m$^2$, wherein the compression path has a length greater than the stack length, and wherein, during compression, the stack moves along the compression path with respect to the compression members.

2. The method according to claim 1, wherein the first and second transport surfaces comprise conveyor belts carried by the first and second compression members, and the method further comprises driving the conveyor belts to transport the stack along the compression path.

3. The method according to claim 1, further comprising moving the first compression member towards and into engagement with the stack only after the stack is fully located in the compression path.

4. The method according to claim 1, wherein the first compression member is moved to a position corresponding to the second spacing before a leading end of the log exits the compression path.

5. The method according to claim 1, wherein the first compression member comprises a plurality of compression elements aligned along the compression path between the input end and the output end, and the method further comprises moving a first compression element located closest to the input end from the second spacing towards the first spacing once a trailing end of the log has been transported past the first compression element; and transporting a subsequent stack of folded absorbent tissues into the compression path before the trailing end of the log has exited the output end of the compression path.

6. The method according to claim 1, further comprising applying an attachment strip to an upper tissue and/or a lower tissue of the stack prior to delivering the stack to the compression path.

7. The method according to claim 1, further comprising delivering the log from the compression path to a bander apparatus and wrapping it in a wrapping web, wherein the bander apparatus maintains the log at a compression amount corresponding to that at the output end of the compression path.

8. The method according to claim 1, further comprising sawing the log into a plurality of individual tissue bundles.

9. The method according to claim 1, wherein the stack is compressed with a pressure of greater than 160 kN/m$^2$ and optionally greater than 225 kN/m$^2$.

10. The method according to claim 1, wherein the tissues comprise dry crepe material or structured tissue material, and wherein the tissues are interleaved in a V, M or Z configuration.

11. The method according to claim 1, wherein the stack is transported at a speed of greater than 0.3 m/s.

12. The method according to claim 1, further comprising moving the first compression member towards the second compression member until a pre-determined pressure is achieved.

13. A compression apparatus for compressing an elongate stack of folded absorbent tissues to form a tissue log, the apparatus comprising:

first and second opposed compression members, the compression members being spaced from one another and provided with respective first and second transport surfaces defining a compression path therebetween, the transport surfaces being operable to transport a stack along the compression path from an input end to an output end; and an actuator mechanism for moving the first compression member towards the second compression member from a first spacing to a second spacing wherein the stack is compressed with a pressure of greater than 120 $kN/m^2$ to form the log, while continuing to transport the stack relative to the compression members along the compression path.

14. The apparatus according to claim 13, wherein the first transport surface is parallel to the second transport surface.

15. The apparatus according to claim 13, wherein the first transport surface comprises a conveyor belt.

16. The apparatus according to claim 13, wherein the first compression member comprises a plurality of compression elements aligned along the compression path between the input end and the output end.

17. The apparatus according to claim 16, wherein the compression elements comprise overlap portions which overlap each other such that the first transport surface is continuous between adjacent compression elements, wherein the compression elements each comprise two or more parallel conveyor belts extending side by side, with the overlap portions extending along the compression path between the conveyor belts, and wherein the actuator mechanism comprises a plurality of actuators for independently moving the plurality of compression elements between the first spacing and the second spacing.

18. A packaging system comprising the apparatus according to claim 13, and further comprising a bander apparatus aligned with the second end of the compression path for receiving the log and wrapping it in a wrapping web.

19. The system according to claim 18, wherein the bander apparatus comprises a transport path having a height corresponding to the second spacing whereby the log can be transported from the compression path through the transport path without loss in compression.

20. The system according to claim 18, further comprising a saw for cutting the log into individual tissue bundles.

21. The system according to claim 18, further comprising an attachment applying apparatus aligned with the first end of the compression path, for application of attachment elements to an upper tissue and/or a lower tissue of the stack and delivering the stack to the compression path.

* * * * *